United States Patent [19]

Smith et al.

[11] Patent Number: 4,760,832

[45] Date of Patent: Aug. 2, 1988

[54] METERING OF FUEL TO AN ENGINE

[75] Inventors: Darren A. Smith, Scarborough; Michael L. McKay, Willetton; Christopher N. F. Sayer, Ferndale, all of Australia

[73] Assignee: Orbital Engine Company Proprietary Limited, Balcatta, Australia

[21] Appl. No.: 918,312

[22] Filed: Oct. 14, 1986

[30] Foreign Application Priority Data

Oct. 14, 1985 [AU] Australia ..... PH2900
May 22, 1986 [AU] Australia ..... PH6040

[51] Int. Cl.[4] ..... F02M 21/02
[52] U.S. Cl. ..... 123/525; 123/531
[58] Field of Search ..... 123/531, 525

[56] References Cited

U.S. PATENT DOCUMENTS 4,170,205 10/1979 Fiedler ..... 123/533
4,363,308 12/1982 Emmenthal et al. ..... 123/533
4,519,356 5/1985 Sarich ..... 123/531
4,554,945 11/1985 McKay ..... 123/533
4,556,037 12/1985 Wisdom ..... 123/533
4,570,598 2/1986 Samson et al. ..... 123/585
4,628,888 12/1986 Duvet ..... 123/531

*Primary Examiner*—E. Rollins Cross
*Attorney, Agent, or Firm*—Murray and Whisenhunt

[57] ABSTRACT

A fuel metering and injection system for an internal combustion engine circulates fuel through a metering chamber (11) via valved fuel inlet and fuel outlet ports (25, 26) to prepare a metered quantity of fuel. Compressed gas is introduced into the metering chamber through a valved air inlet port (14) to displace the metered fuel and deliver it to the engine. Phasing of the valves is controlled to ensure that the fuel inlet and outlet valves (60, 61) are closed prior to opening of the air inlet valve (16), and that on completion of the injection phase residual gas in the metering chamber (11) is expelled through the fuel outlet port (26).

35 Claims, 5 Drawing Sheets

METERING OF FUEL TO AN ENGINE

This invention relates to an improvement in apparatus for metering fuel to an internal combustion engine, wherein the quantity of fuel delivered may be varied in accordance with engine load by controlling the quantity of fuel displaceable from a metering chamber by a pulse of gas.

It has previously been proposed in U.S. Pat. No. 4,554,945 to vary the quantity of fuel displaceable from a metering chamber by providing a metering rod which extends into the chamber and is connected to an external actuator, whereby the degree that the metering rod projects into the metering chamber may be varied in accordance with fuel requirements. It will be appreciated that the movement of the metering rod must be accurately controlled, as under normal operating conditions the need for accurate metering of the fuel requires relatively small degrees of movement, with such movements being effected in the matter of a few milliseconds.

In the above apparatus the metered quantity of fuel prepared in a metering chamber is delivered from the chamber to the engine by the admission of gas to the chamber at a suitable pressure. Gas is supplied cyclically to the metering chamber to deliver the fuel to the engine in timed relation to the engine cycle. A pressure operated valve is provided in a port through which the gas is admitted to the metering chamber.

The prior proposed constructions present operational and manufacturing problems that partly arise from the space constraints inherent in the designs, having regard to the small size of the metering chamber. The problem is more pronounced in metering apparatus for popular size automotive engines, where the metered quantity of fuel is relatively small particularly at engine idle conditions.

Also, in the prior proposed designs, the opening and closing of the valve that controls the gas supply to the metering chamber and the commencement and termination of the fuel supply to the metering chamber, are controlled from the same cyclic gas supply. This operational mode presents problems in obtaining the correct sequencing between the gas and fuel supplies to the chamber.

It is therefore an object of the present invention to provide a method and apparatus for delivering metered quantities of fuel to an engine which is effective in operation, reliable in service and convenient to manufacture.

With this object in view there is provided a method of delivering fuel to an engine including circulating fuel through a metering chamber to prepare a metered quantity of fuel in said chamber, and discharging the metered quantity of fuel from the metering chamber for delivery to the engine by the admission of gas to the metering chamber to displace the metered quantity of fuel therefrom, the improvement comprising controlling the fuel circulation by means operable to terminate circulation in response to a predetermined pressure of the gas available for admission to the metering chamber, cyclically supplying gas at at least said predetermined pressure to effect termination of fuel circulation and to said metering chamber to displace the fuel therefrom in a sequence so that circulation of the fuel is terminated before the gas is admitted to the metering chamber.

Conveniently the supply of gas to the metering chamber is terminated prior to recommencement of the circulation of fuel through the metering chamber. Preferably in the recommencement of circulation of fuel through the metering chamber the chamber is communicated with a fuel return circuit not later than and preferably before the chamber is communicated with a fuel supply circuit.

In another form of the invention there is provided apparatus for delivering fuel to an engine comprising a metering chamber in which a metered quantity of fuel is collected for delivery to an engine, means to circulate fuel through the metering chamber to establish said metered quantity of fuel therein, means operable to selectively admit gas to the metering chamber to displace the metered quantity of fuel therefrom for delivery to the engine, means to control the fuel circulation by terminating of circulation in response to a predetermined pressure of the gas available for admission to the metering chamber, means to cyclically supply gas at at least said predetermined pressure to terminate fuel circulation and admit gas to the metering chamber to displace the fuel therefrom in a sequence so that circulation is terminated before gas is admitted to the metering chamber.

Conveniently the means to control the fuel circulation includes an in flow valve means and an out flow valve means by which the fuel enters and leaves respectively the metering chamber during circulation. Each said valve means is operable to close in response to the application of gas at a pressure above a predetermined value to respective valve means actuators. Preferably gas control means are provided to apply gas at at least said pressure to said valve means actuators and to supply gas for admission to said metering chamber in sequence from a common gas supply. The gas control means preferably includes a gas control valve operable in response to partial closure of at least one of said in flow and out flow valve means, preferably the in flow valve means, to initiate the supply of gas from said common gas supply for admission to the metering chamber. The gas control valve is arranged so that the in flow and out flow valve means are fully closed before gas is admitted to the metering chamber. The in flow and out flow valve means may each be in the form of a valve element movable between open and closed positions. A diaphragm is associated with each valve element to move it to a closed position in response to deflection thereof when the gas is applied to one side thereof at a pressure above said predetermined valve. One of said diaphragm is arranged to also operate said gas control valve to provide gas for admission to the metering chamber.

Conveniently the means to control the fuel circulation through the metering chamber is adapted to reestablish fuel circulation, after discharge of the metered quantity of fuel from the metering chamber, by opening both the in flow and out flow valve means, with the out flow valve means being opened first.

Also there is provided apparatus for delivering fuel to an engine comprising a metering chamber in which a metered quantity of fuel is collected for delivery to the engine, means to circulate fuel through the chamber to fill the chamber, a fuel inlet and fuel outlet by which said circulated fuel is conducted to and from the chamber, means to establish communication between the chamber and the fuel inlet, means to establish communication between the chamber and the fuel outlet, means operable to selectively admit gas to the chamber to displace the metered quantity of fuel therefrom for delivery to the engine, means to sequentially repeat said circulation of fuel through and admission of gas to the chamber, means to control said circulation of fuel through and said admission of gas to the chamber whereby:

the circulation of fuel is terminated before the admission of gas is commenced;

the admission of gas is terminated before the circulation of fuel is commenced; and, for a given establishment of fuel circulation communication between the chamber and the fuel outlet is established not later than the establishment of communication between the chamber and the fuel inlet.

In another form of the present invention there is provided in a method of deliverying fuel to an engine wherein a metered quantity of fuel is prepared in a chamber and discharged from said chamber for delivery to the engine by the admission of gas to the chamber to displace the metered quantity of fuel therefrom, the improvement comprising opening a port to admit gas to the chamber in response to the gas at said port being above a first pressure, and regulating the supply of gas to said port from a gas source so gas is only supplied to the port when the pressure of the gas source is above a second pressure that is above said first pressure.

Conveniently the supply of gas to the gas port is terminated each cycle when the pressure of the gas supply at the gas port is below the second pressure and preferably at or near the first pressure.

Conveniently fuel is circulated through the chamber to fill the chamber with fuel, and the chamber is isolated from the fuel circuit during the period that the gas supply is in communication with the chamber. Preferably the circulation of the fuel through the chamber is controlled by the same gas supply as effects displacement of the fuel from the metering chamber. Conveniently the fuel circulation is initiated and terminated when the gas supply is at a pressure below said second pressure, and is preferably initiated when the gas supply pressure is below said first pressure.

There is also provided by the present invention an engine fuel metering apparatus comprising a chamber to receive fuel, a delivery port in said chamber selectively openable to deliver fuel from the chamber, means to selectively admit gas to said chamber at a pressure to displace fuel therefrom through the delivery port, and means responsive to fuel demand to vary the quantity of fuel displaceable from the chamber, said means to selectively admit gas to the chamber including a gas port to communicate the chamber with a gas supply, means operable to selectively open said gas port in response to gas supply pressure at the port being above a predetermined first pressure, and means intermediate the gas supply and the gas port selectively openable in response to the gas supply being above a predetermined second pressure to permit gas to pass to the means to open said port, said second pressure being greater than said first pressure.

Conveniently the intermediate means is operable to close when the gas supply is at a pressure below said second pressure and preferably at or near said first pressure.

The means to vary the quantity of fuel displaceable from the chamber may include a member extending into the chamber and supported so the extent of projection of the member into the chamber may be varied. The gas port is conveniently provided in that part of the member that extends into the chamber.

Conveniently the gas port is provided with a resiliently deformable valve element adapted to deform to open the port when the gas supply at the port is above the first pressure. The valve element may be attached to a support, having a fixed relation to the gas port, so that the valve element is resiliently deformed when the gas port is closed by the valve element. The degree of deformation of the valve element is increased in order to open the gas port.

Conveniently the chamber is provided with fuel inlet and outlet ports so that fuel may be circulated through the chamber to effect filling thereof with fuel. The fuel inlet and outlet ports are preferably valve controlled to open and close at substantially the same time. The fuel ports are preferably closed before the gas port opens to admit gas to the chamber, and opened after the gas port is closed.

Conveniently the operation of the fuel ports is effected in response to selected pressure conditions of the cycling gas supply to the gas port, so that the fuel ports are closed at substantially the same time or before the second means operates to communicate the gas supply with the gas port. Also as previously referred to, the second means may be arranged to terminate the gas supply to the gas port at a lower pressure than the second pressure, and the fuel ports may be arranged to open when the gas pressure in the chamber is below said second pressure and preferably below that required to displace the fuel from the chamber. This feature has the advantage of reducing the mass of air trapped in the chamber when the gas port closes, and consequently reduces thee gas mass entrained in the circulating fuel for return to the fuel reservoir, and so the vapour burden on the emissions control equipment is reduced. This vapour burden is also influenced by the reset or closing pressure of the first means controlling the gas flow through the gas port. If this closing pressure is close to the pressure at which the second means terminates the flow of gas to the gas port, there will be a minimisation of return flow of the gas trapped between first and second means into the chamber.

The invention will be more readily understood from the following description of practical arrangements of the metering apparatus as illustrated in the accompanying drawings.

Figure 1:
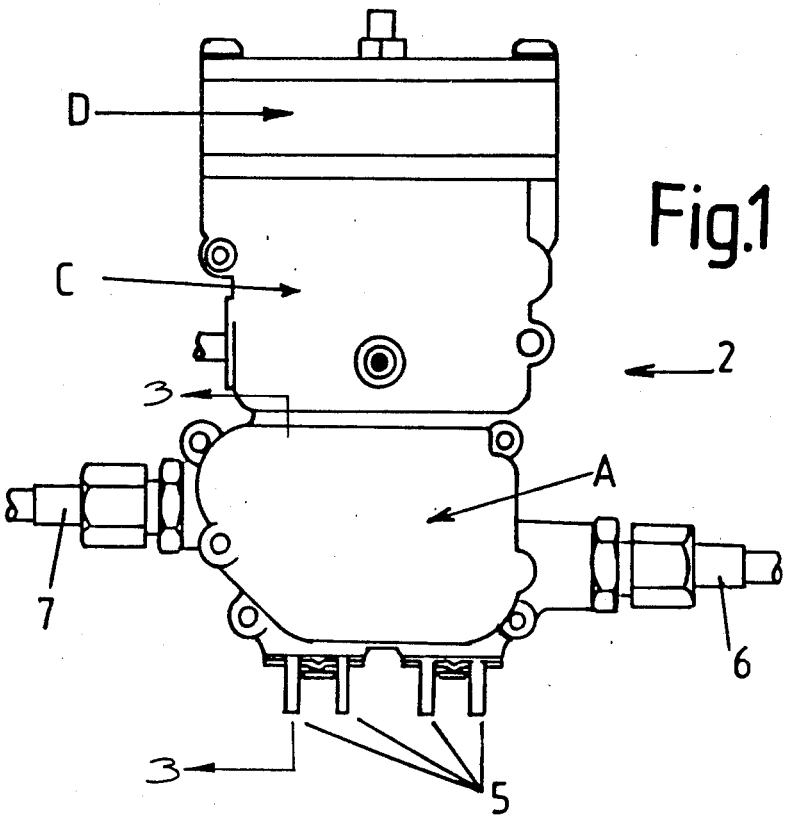
FIG. 1 is a side elevational view of the complete fuel metering unit for a four cylinder engine.
Figure 2:
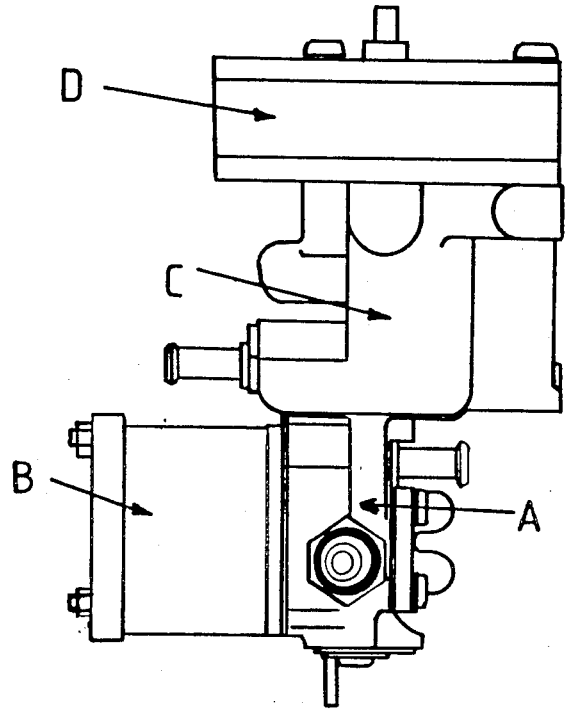
FIG. 2 is a elevational view in the direction of arrow '2' in FIG. 1.
Figure 3:
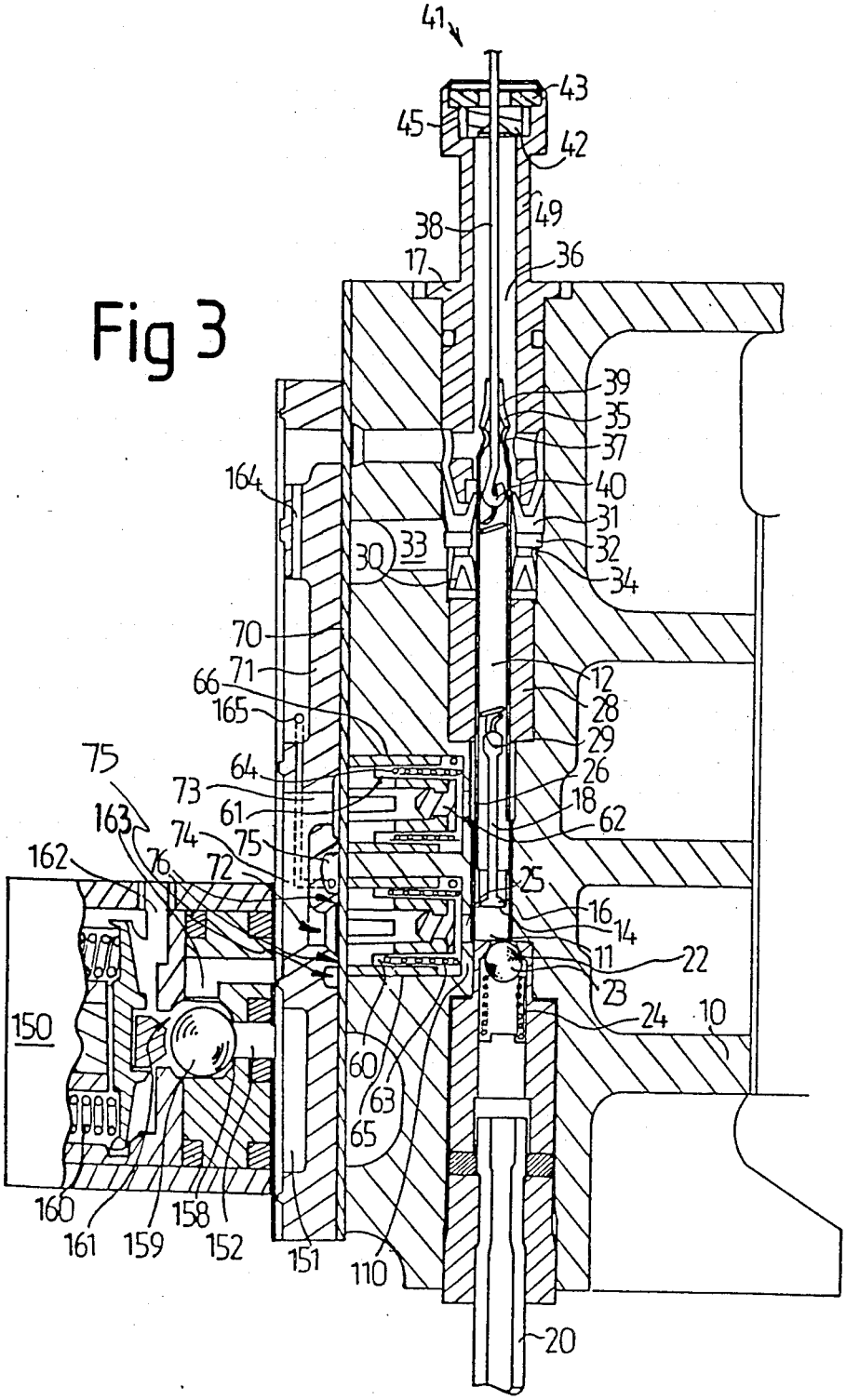
FIG. 3 is a sectional view along line 3—3 in FIG. 1 of the metering section of the unit.

Referring now to FIGS. 1 and 2 the metering unit has a metering portion A incorporating four metering chambers one of which is shown in section in FIG. 3. The fuel from each metering chamber is delivered to an individual cylinder of an engine by its respective tubes 5. Fuel is supplied from a fuel tank through the pipe 6 to a common gallery in portion A for each metering chamber. Excess fuel is returned to the fuel tank by the pipe 7 that is also connected to a common gallery in portion A.

The solenoid assembly B incorporates four solenoid actuated valves, one for each metering unit, to control the supply of air to operate fuel valves and the air supply for each metering unit. One solenoid valve unit 150 is shown in detail in FIG. 3.

The actuator portion C of the metering unit incorporates the mechanism whereby the motor D effects control of the quantity of fuel metered to the engine by each metering chamber.

Figure 4:
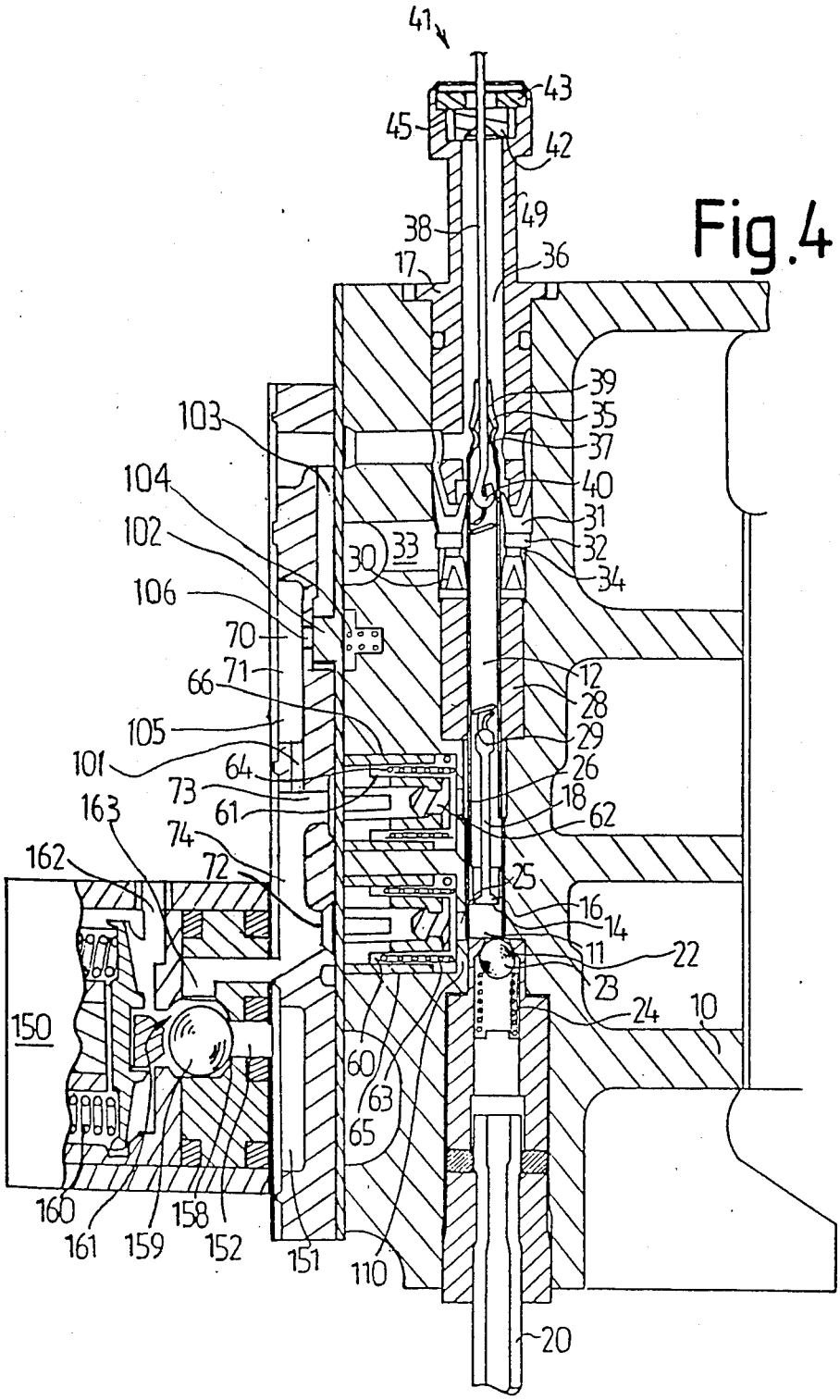
FIG. 4 is a sectional view similar to FIG. 3 of a modified form of the metering unit.
Figure 5:
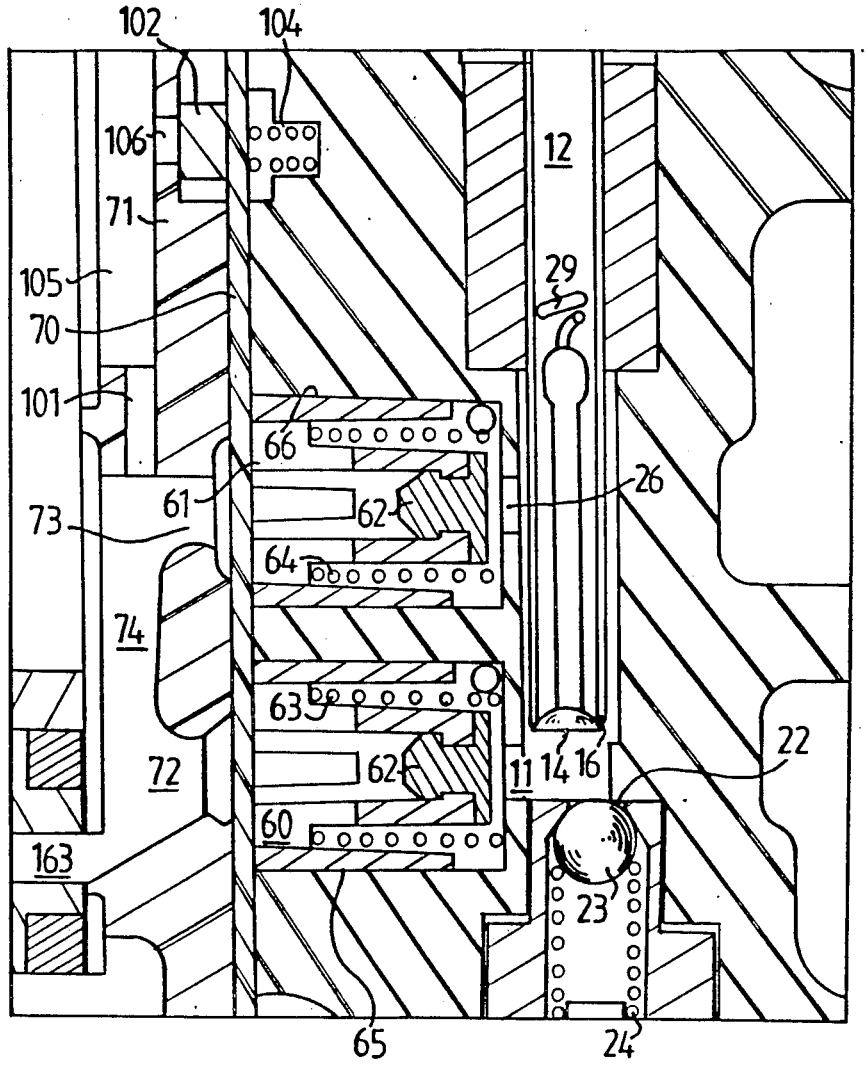
FIG. 5 is an enlarged view of portion of FIG. 4.

Referring to FIGS. 3, 4 and 5 of the drawings, the metering apparatus comprises a body 10 having a metering chamber 11 formed therein with a metering rod 12 extending co-axially from one end into the metering chamber and slideably supported in the bush 28 mounted in the body 10. The metering rod 12 is of a tubular form throughout the majority of its length having a port 14 at the lower end normally closed by the poppet valve 16. The valve 16 is connected via the rod 18 to a spring 29 anchored at the opposite end of the metering rod 11 via the hook 40.

At the end of the metering chamber 11, opposite that through which the metering rod 12 extends, is a fuel delivery port 22 normally closed by a spherical valve element 23 biased by the spring 24 into the closed position. Fuel inlet and outlet ports 25 and 26 respectively communicate with the metering chamber 11 at locations spaced along the length thereof.

Respective valves 60 and 61 are provided to control the fuel flow through the ports 25 and 26. Each of the valves includes a seal insert 62 of a suitable slightly resilient material, such as neoprene rubber or like material inert to the fuel. The seal inserts contact the area of the body 10 about the ports 25 and 26 to close the ports when required. The valves 60 and 61 are each biased towards an open position by the springs 63 and 64, and are shown open in FIGS. 3, 4 and 5. The spring 64 which holds the valve 61 of the fuel outlet port 26 open is of a slightly higher load rating than the spring 63 for reasons that will be discussed later.

The valves 60 and 61 are slidable in respective bores 65 and 66 in the body 10 in which they are located to effect opening and closing of the ports 25 and 26. The valves 60 and 61 at the ends thereof opposite the seal inserts 62 each engage the rubber diaphragm 70 held between the body 10 and the air gallery plate 71. The air gallery plate 71 defines with the diaphragm 70 a fuel inlet valve chamber 72 and a fuel outlet valve chamber 73 each communicating with the air supply chamber 74.

In the embodiment shown in FIG. 3, the chamber 72 has an annular transfer chamber 75 extending thereabout and is normally separated therefrom by the annular land 76 engaging the diaphragm 70. It will be noted that the annular land 76 engages the diaphragm 70 within the boundary of the area engaged by the inlet valve 60 on the opposite side of the diaphragm. It will also be noted that the area of the diaphragm exposed to chamber 72 is less than that exposed to chamber 73, each chamber being of circular cross section with chamber 72 of lesser diameter than chamber 73.

This arrangement of the chambers 72 and 73 and the annular transfer chamber 75 and the differing strengths of the springs 63 and 64, is provided to achieve a particular sequence of events when the air supply chamber 74 is coupled to a supply of compressed air. This sequence of events is:

(a) Upon the initial supply of compressed air to the chamber 74, and hence to chambers 72 and 73, the valve 61 will have a larger force applied thereto by the diaphragm than is applied to valve 60. This is due to chamber 73 having a greater area exposed to the diaphragm than chamber 72 and will partly compensate for the spring 64 being stronger than the spring 63.

(b) Valve 60 commences to move before valve 61 towards the closed position and the resulting deflection of the portion of the diaphragm 70 exposed to chamber 72 will break the sealing relationship thereof with the annular land 76, and the air will enter the annular transfer chamber 75.

(c) The transfer chamber 75 provides communication between the air supply chamber 74 and the hollow interior of the metering rod 12 which effects the opening of the valve 16. However as there is a time delay between commencement of the closing of the fuel inlet and outlet ports and admission of the air to the transfer chamber 75, and as time is required for the pressure to rise at the valve 16, it will be appreciated that both the fuel inlet and outlet ports 25 and 26 will be closed before the valve 16 will open. The air circuit from the transfer chamber 75 to the valve 16 will be described in detail later in this specification.

(d) Upon termination of the supply of compressed air to the chamber 74, and the venting thereof to atmosphere (as hereinafter described) the air pressure in metering rod 12 and the chambers 72 and 73 will fall so that the valve 16 will close and valves 60 and 61 open. However as the spring 64 has a higher load rating than spring 63, the valve 61 will open slightly before valve 60. Accordingly the air present under pressure in the metering chamber 11 will be vented through the fuel outlet port 26 in preference to through the fuel inlet port 25. The venting of the air through the fuel outlet port is important as the presence of air in the fuel inlet port, and fuel passages leading thereto, can servely interfere with the subsequent filling of the metering chamber with fuel in preparation for the next fuel delivery cycle.

Further details of the general construction of the metering unit shown in FIGS. 3 and 4 will be found in the Australian Patent Application No. 58036/86, and the corresponding U.S. patent application Ser. No. 866,425 filed May 23rd 1976, the disclosures in which are incorporated herein by reference.

Briefly the fuel delivery aspect of the operation of the metering unit is that the delivery of fuel from the metering chamber 11 to the engine is effected by admitting air to the metering chamber from the gas chamber 36 through the valve 16, and the opening of the fuel delivery port 22. The pressure of the air supplied to the gas chamber 36 is sufficient to open the valve 16, normally held closed by the spring 29, and open the delivery valve element 23, normally held closed by the spring 24. In addition the air pressure is sufficient to displace the fuel in the metering chamber between the ports 14 and 22, and convey it to the point of delivery to the engine through the fuel conduit 20. The above principle of discharging a metered quantity of fuel from a metering chamber by a pulse of air, and varying the metered quantity by adjusting the position of entry of the air to the chamber is discussed in detail in U.S. Pat. Nos. 4,462,760 and 4,554,945 which are hereby incorporated in this specification by reference.

In each of the embodiments of the metering unit illustrated in FIGS. 3 and 4 control of the admission of air to the air supply chamber 74, is regulated in time relation with the cycling of the engine by the solenoid operated valve 150. The common air supply conduit 151 connected to a compressed air supply not shown, extends through the air gallery plate 71 with respective branches 152 providing air to the respective solenoid valve 150 of each metering unit.

Normally the spherical valve element 159 is seated in the port 158 by the springs 160 to prevent the flow of air from conduit 151 to chamber 74, and to vent the chamber 74 to atmosphere via vent port 161 and passage 162. When the solenoid is energised the force of the springs 160 is released from the valve element 159. This is the position shown in FIGS. 3, 4 and 5. The valve element 159 is then displaced by the pressure of the air supply to open the port 158 and permit air to flow from conduit 151 via port 163 to the chamber 74 and to close the port 161. The admission of the air to the chamber 74 effects closure of the fuel inlet and outlet ports as previously described. In particular reference to the embodiment in FIG. 3, after the diaphragm 70 has been deflected sufficiently to permit the air to enter the annular transfer chamber 75 air will then pass via the ducts 165 and 164 to the gas chamber 36. The air then passes through the opening 37 into the hollow metering rod 12 and effects opening of the valve 16 so air enters the metering chamber through the port 14.

As previously referred to there is a small time delay between the closing of the fuel inlet and outlet ports 25 and 26 and the air pressure rising in the metering rod sufficient to open the gas port 14. This delay contributes to ensuring that the air is not admitted to the metering chamber before the fuel inlet and outlet ports are closed. Premature admission of air to the metering chamber would result in some of the metered quantity of fuel in the metering chamber being discharged through the fuel outlet port 26 and forced back through the fuel inlet port 25, thus reducing the quantity of fuel available for delivery to the engine through the delivery port 22.

After air has been supplied to the metering chamber 11 for a period sufficient to displace the metered quantity of fuel therefrom and deliver the fuel to the engine the solenoid is de-energised and the valve element 159 again closes the port 158 to terminate the supply of compressed air to the air supply chamber 74. As a result of the closing of port 158 the port 161 is opened so that the chamber 74 is vented to atmosphere via port 163 and passage 162. The gas port 14 is then closed, the fuel outlet port opened to vent the metering chamber 11 and the fuel inlet port 25 opened so that the metering chamber 11 is filled with fuel preparatory to the next fuel delivery.

Reference has previously been made to the desirability of the fuel outlet port opening in advancing the fuel inlet port 25, this principally being achieved by the spring 64 being stronger than the spring 63, so the air in the metering chamber 11 is vented through the fuel outlet port 26, in preference to the fuel inlet port 25. This sequencing can be effected or further assisted by providing a direct passage from the chamber 73 to the port 163 bypassing the chamber 74. Accordingly when the port 161 opens to generally vent the air from chamber 74 to atmosphere, there is a direct venting of the chamber 73 to the port 161. This direct venting of chamber 73 will promote a more rapid lowering of the pressure in the vicinity of the diaphragm 70 in the chamber 73, than the lowering of the pressure in the chambers 74 and 72, as the whole air capacity of the metering unit from the gas chamber 36 downstream to the chamber 74 must vent through the chamber 74.

There has been described above with reference to FIG. 3 how a sequencing can be achieved in relation to the opening of the gas port 14 and the closing of the fuel inlet and outlet ports 25 and 26 by means of the transfer chamber 75. There is shown in FIGS. 4 and 5 an alternative arrangement which will achieve the same sequencing and has additional beneficial characteristics. Apart from the modifications described below the construction of the metering apparatus shown in FIG. 4 is essentially the same as previously described with reference to FIG. 3.

In the alternative construction the air supply chamber 74 is in communication with the air chamber 36 via the conduit 101, gallery 105, port 106, and conduit 103 with the diaphragm valve 102 controlling the port 106. The spring 104 biases the valve 102 to the position to close the port 106 and so isolate conduit 101 from conduit 103 to prevent the flow of air from chamber 74 to chamber 36. It is to be noted that the total area of the diaphragm valve 102 exposed to the air in conduit 103 when the valve is open is greater than that exposed in the port 106 to the air in gallery 105 when the valve is closed. This arrangement results in the pressure necessary in the gallery 105 to deflect the diaphragm so the valve 102 opens the port 106 is greater than the air pressure in the conduit 103 and gallery 105 at which the spring 104 will close the port 106.

The load rating of the spring 104 and the area of the valve 102 exposed to the gallery 105 when the port is closed are selected so that the air pressure in the gallery 105 necessary to open the port 106 is higher than that necessary to close the fuel inlet and outlet valves 60 and 61. Also the air pressure necessary to open the port 106 is higher than that required to open the valve 16 in the metering rod.

The difference in the pressures of opening and closing port 106 is determined by the ratio of the respective areas of the valve exposed to the air pressure. Preferably the areas are arranged so that port 106 closes at substantially the same pressure as port 14. If the port 106 is closed at a pressure above that at which the port 14 is closed, the gas trapped in the chamber 36 and metering chamber 11 at that higher pressure must be exhausted through the fuel outlet port 26 when it opens until the pressure drops sufficiently for the valve 16 to close the port 14. This increases the mass of air returned to the fuel supply and so increases the vapour burden required to be handled by the fuel system.

In the construction shown in FIGS. 3 and 4 the valve 16 is loaded to the closed position by the spring 29. The spring is located within the tubular metering rod 12, and in view of the relatively small diameter of the bore of the rod 12, and the necessity of the gas to flow therethrough, the spring 29 must be relatively small in wire size and diameter. This presents a difficulty in obtaining the required spring rate in the spring 29, and also in assembling the spring in the metering rod. The spring rate is particularly important in relation to the embodiment shown in FIG. 3 as it determines the pressure at which the valve 16 opens and closes the gas port 14 controlling the gas flow to the metering chamber 11. Further this opening and closing of the valve 16 should be effected at a pressure at least slightly above that at which the fuel inlet and outlet ports open and close as previously described.

In the embodiment shown in FIG. 4 the port 106 and valve 102 provide the control over the sequencing of the admission of the gas through the port 14 and so the spring 29 may be of a low rate. In fact the only function that the valve 16 must perform in that embodiment is to prevent the flow of fuel from the metering chamber 11 into the gas chamber 36.

Figure 6:
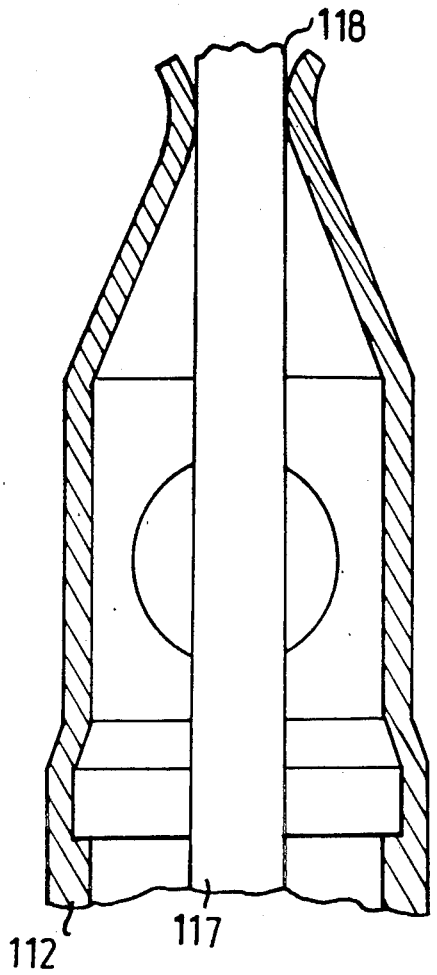
FIG. 6 is an enlarged view of a modified form of the gas valve and metering rod of FIG. 4.
Figure 6:
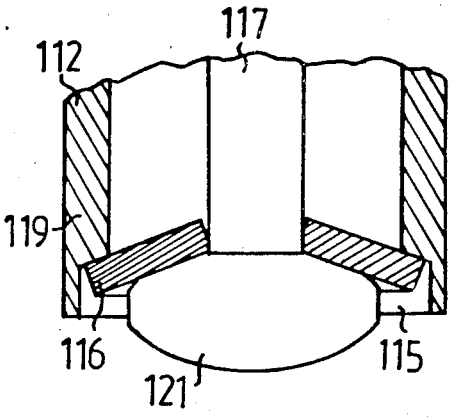
Figure 6A:
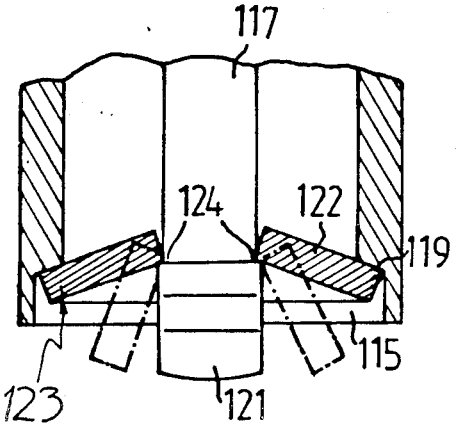
FIG. 6a is a view of the lower portion of the gas valve in the direction Y in FIG. 6.

There is shown in FIGS. 6 and 6a an alternative construction of the metering rod and gas port and valve that may replace these components as previously described with reference to FIG. 4. In this construction the valve 116 is a disc of resilient flexible material, such as a rubber or plastic suitable for use in a fuel environment, that is supported by the wire 117 anchored at 118 to the upper end of the metering rod 112.

The lower end of the metering rod is recessed at 115 to form the internal annular shoulder 119, the valve 116 being normally received in the recess seated on the shoulder 119, to prevent the passage of fuel from the metering chamber into the hollow interior 120 of the metering rod.

The crossbar 121 is secured to the end of the wire 117 and extends diametrically across the lower side of the disc valve 116. The crossbar 121 is of a length to be received within the end of the recess 115 in the end of the metering rod and less than the internal diameter of the should 19. Also the length of wire 117 is such that the disc valve 116 is resiliently deflected into a slightly dished form by the crossbar 121. In this way the crossbar 121 holds the the valve 116 in a sealing relation against the shoulder 119 and the valve 116 is maintained coaxial with the metering rod and the recess 115.

Upon the pressure of the air in the gas chamber 36, and hence also in the interior 120 of the metering rod 112 being above the pressure in the metering chamber 11 the portions 122 and 123 of the disc valve 116 one either side of the cross bar 121 are deflected downward about the opposite edges 124 of the crossbar as viewed in FIG. 6a to the positions shown in broken outline. Air is thus admitted to the metering chamber 11 to effect delivery of the fuel therefrom.

The pressure of the air in the gas chamber reaches the necessary pressure to effect said deflection of the valve 116 when the valve 102 opens port 106 to communicate the chambers 74 and 36. Upon closing of the port 106, at the lower pressure than it is opened as previously discussed, the resilience of the disc valve 116 will cause it to return to the form seated along its periphery on the shoulder 119.

The elimination of the need for a spring loading on the valve in the metering rod to control the admission of the air to the metering chamber significantly simplifies the construction of the metering rod and its valve from both the point of view of construction of components and assembly, and improves reliability in service. This is possible by the use of the valve 102 and port 106 to achieve the required sequencing of the closure of the fuel port and the admission of the air to the metering chamber.

The disc form of the valve 116 as shown in FIG. 6, which is produced as a flat disc, is particularly simple in construction and effective in operation. However other forms of simple check valves may be used as an alternative thereto, particularly other forms of resiliently deformable valves that operate in response to a low pressure differential thereacross.

In the embodiment of the invention as described with reference to FIG. 4, modified as described with reference to FIGS. 6 and 6a, to incorporate the resilient disc valve, typical pressures for operation of the various valves to obtain the required sequence of operations, as previously discussed, are as follows:

| | |
|---|---|
| Fuel Supply Pressure | 100 KPa gauge |
| Gas supply Pressure | 600 KPa gauge |
| Crack Pressure of Fuel Valves 25 and 26 | 80 KPa |
| Crack Pressure of Gas Valves 116 | 40 KPa |
| opens and closes | |
| Crack Pressure of Sequencing Valve 102 | |
| opens | 130 KPa |
| closes | 80 KPa |
| Crack Pressure of Fuel Delivery Valve 22 | 230 KPa |
| opens and closes | |

The method and apparatus previously described are suitable for use with spark ignited internal combustion engines operating on either the two stroke or four stroke cycle, and engines for a wide variety of uses including vehicle engines and marine engines such as automobile engines and outboard marine engines.

The claims defining the invention are as follows; We claim:

1. A method of delivering fuel to an engine including circulating fuel through a metering chamber to prepare a metered quantity of fuel in said chamber, and discharging the metered quantity of fuel from the metering chamber for delivery to the engine by the admission of gas to the metering chamber to displace the metered quantity of fuel therefrom, the improvement comprising controlling the fuel circulation by means operable to terminate the circulation in response to a predetermined pressure of the gas available for admission to the metering chamber, cyclically supplying gas at at least said predetermined pressure, to effect termination of fuel circulation and to said metering chamber to displace the fuel therefrom, in a sequence so that circulation of the fuel is terminated before the gas is admitted to the metering chamber.

2. A method as claimed in claim 1 wherein the gas is cyclically supplied at at least said predetermined pressure to a distribution chamber in direct communication with said circulation control means, and communication between said distribution chamber and the metering chamber is established in response to activation of said circulation control means.

3. A method as claimed in claim 1 wherein the gas is cyclically supplied at at least said predetermined pressure to a distribution chamber in direct communication with said circulation control means, and gas is supplied from the distribution chamber for admission to the metering chamber only after the pressure in the distribution chamber is above the predetermined pressure that activates said circulation control means.

4. A method as claimed in any one of claims 1 to 3 wherein the supply of gas to the metering chamber is terminated after delivery of the metered quantity of fuel and before circulation of fuel through the metering chamber is recommenced.

5. A method as claimed in any one of claims 1 to 3 wherein the metering chamber has a fuel inlet port and a fuel outlet port, both of which are closed when circulation is terminated, and wherein during recommencement of circulation the fuel outlet port is opened before the opening of the inlet port.

6. A method as claimed in claim 1 wherein a port is opened to admit gas to the metering chamber in response to the gas at said port being above a first pressure, and the supply of gas to said port from a gas source is regulated so gas is only supplied to the port when the pressure of the gas source is above a second pressure greater than the first pressure.

7. A method as claimed in claim 6 wherein said second pressure is above the pressure required to activate the circulation control means to terminate circulation.

8. A method as claimed in claim 6 or 7 wherein the supply of gas to the port is terminated when the gas source is at a pressure between said first and second pressures.

9. A method as claimed in claim 6 or 7 wherein the supply of gas to the port is terminated when the pressure of the gas source is substantially said first pressure.

10. A method as claimed in any one of claims 6 or 7 wherein the circulation of fuel through the metering chamber is terminated when the pressure of the gas source is below said second pressure.

11. A method as claimed in any one of claims 6 or 7 wherein circulation of fuel through the metering chamber is terminated when the pressure of the gas supply is between the first and second pressures.

12. A method of delivering fuel to an engine including circulating fuel through a metering chamber to prepare a metered quantity of fuel in said chamber, and discharging the metered quantity of fuel from the metering chamber for delivery to the engine by the admission of gas to the metering chamber wherein first means controlling admission of gas to the metering chamber admits gas when the pressure of the gas available for admission is above a first pressure, and gas is provided from a source to said first means for admission to the metering chamber when the pressure of the source is above a second pressure that is greater than said first pressure.

13. A method as claimed in claim 12 wherein the provision of gas to said first means is terminated when the pressure of the source gas is between said first and second pressures.

14. A method as claimed in claim 12 wherein the provision of gas to said first means is terminated when the pressure of the gas supply is substantially said first pressure.

15. A method as claimed in any one of claims 1, 2, 13 or 14 wherein circulation of the fuel through the metering chamber is terminated when the pressure of the gas source is below said second pressure.

16. A method as claimed in any one of claims 12, 13 or 14 wherein circulation of fuel through the metering chamber is terminated when the pressure of the gas source is between said first and second pressures.

17. Apparatus for delivering fuel to an engine comprising a metering chamber in which a metered quantity of fuel is collected for delivery to an engine, means to circulate fuel through the metering chamber to establish said metered quantity of fuel therein, means operable to selectively admit gas to the metering chamber to displace the metered quantity of fuel therefrom for delivery to the engine, means to control the fuel circulation by terminating the circulation in response to a predetermined pressure, pressure of the gas being available for admission to the metering chamber means to cyclically supply gas at least said predetermined pressure to terminate fuel circulation and admit gas to the metering chamber to displace the fuel therefrom in a sequence so that circulation is terminated before gas is admitted to the metering chamber.

18. Apparatus as claimed in claim 17 wherein the means to cyclically supply gas initially supplies the gas to the circulation control means, and the means operable to admit gas to the metering chamber is initiated in response to activation of the circulation control means to terminate circulation.

19. Apparatus as claimed in claim 17 wherein the circulation control means is adapted to terminate circulation at a first gas pressure and the means operable to admit gas to the metering chamber is adapted to admit said gas when the gas pressure is raised to a second pressure greater than the first pressure.

20. Apparatus as claimed in claim 19 wherein the means to selectively admit the gas to the metering chamber is adapted to terminate said admission at a pressure below said second pressure.

21. Apparatus as claimed in claim 20 wherein the termination of said admission is at a pressure between said first and second pressures.

22. An apparatus as claimed in claim 17 wherein said means to control the fuel circulation includes an inflow valve means and an outflow valve means by which the fuel enters and leaves respectively the metering chamber during circulation, each said valve means being operable to close in response to application of gas at said predetermined pressure and wherein gas control means are provided to supply gas at least at said pressure to said valve means and to subsequently supply gas for admission to said metering chamber in sequence from a common gas supply.

23. An apparatus as claimed in claim 22 wherein said gas control means includes a gas control valve operable in response to partial closure of at least one of said inflow and outflow valve means to initiate the supply of gas from said common gas supply for admission to the metering chamber, the gas control valve being arranged so that the inflow and outflow valve means are fully closed before gas is admitted to the metering chamber.

24. An apparatus as claimed in claim 23 wherein the inflow and outflow valve means each include a valve element movable between open and closed positions, and a diaphragm is arranged to move each valve element to a closed position in response to deflection of the diaphragm when the gas is applied to one side thereof at at least said predetermined pressure, one of said diaphragms being arranged to operate said gas control valve.

25. An apparatus as claimed in claim 23 wherein said gas control valve is a port normally closed by said one diaphragm and opened upon deflection of said diaphragm to partially close the associated valve means.

26. An apparatus as claimed in any one of claims 22 to 25 wherein the means to control said fuel circulation through the metering chamber is adapted to re-establish fuel circulation, after discharge of the metered quantity of fuel from the metering chamber, by opening both the inflow and outflow valve means with the outflow valve means being opened first.

27. Apparatus for delivering fuel to an engine comprising a chamber to receive fuel, a delivery port in said chamber selectively openable to deliver fuel from the chamber, means to selectively admit gas to said chamber at a pressure to displace fuel therefrom through the delivery port, and means responsive to fuel demand to vary the quantity of fuel displaceable from the chamber, said means to selectively admit gas to the chamber including a gas port to communicate the chamber with a gas supply, means operable to selectively open said gas port in response to the gas supply pressure at the port being above a predetermined first pressure, and means intermediate the gas supply and the gas port selectively openable in response to the gas supply being above a predetermined second pressure to permit gas to pass to the means to open said port, said second pressure being greater than said first pressure.

28. Apparatus as claimed in claim 27 wherein said intermediate means is adapted to isolate the gas supply from the gas port when the pressure of the gas supply fall below a selected pressure between said first and second pressure.

29. Apparatus as claimed in claim 27 wherein said selected pressure is approximately said first pressure and not below said first pressure.

30. Apparatus as claimed in any one of claims 27 to 29 wherein said means to selectively open said gas port include a valve element adapted to normally close said gas port and to resiliently deflect to open the port when the gas supply at the port is above said first pressure.

31. Apparatus as claimed in claim 30 wherein said gas port includes a valve seat, said valve element being supported in an initially resiliently defected state in sealing engagement with said valve seat.

32. Apparatus as claimed in claim 31 wherein the valve element is supported on a member extending transversely of the gas port and located on the opposite side of the valve element to the valve seat, said member presenting to the valve element an edge on either side of the member about which respective parts of the valve element outwardly from said edges are defected away from the valve seat when the gas supply is above said first pressure.

33. Apparatus as claimed in claim 31 or 32 wherein the valve seat is located in the end of a member extending into the metering chamber.

34. Apparatus for delivering fuel to an internal combustion engine comprising a metering chamber to hold fuel for subsequent delivery to an engine by the admission of gas to the chamber, means to circulate fuel through the chamber to provide the quantity of fuel to be displaced therefrom, and means to control said fuel circulation relative to the admission of gas to the chamber, said circulation control means including an inflow port and an outflow port by which the fuel enters and leaves respectively the chamber during circulation, and means operable to cyclically establish and terminate circulation of the fuel by opening and closing said ports and adapted to open the outflow port before opening the inflow port when establishing circulation.

35. A method of delivering fuel to an internal combustion engine comprising circulating fuel through a metering chamber to prepare a metered quantity of fuel in a chamber, introducing gas to said chamber to displace the metered quantity of fuel for delivery to the engine while said circulation of the fuel is terminated, controlling the circulation of fuel through the metering chamber by cyclically opening and closing inflow and outflow ports communicating with the metering chamber to establish and terminate circulation respectively, and during establishment of circulation opening the outflow port before opening the inflow port.

* * * * *